US009566793B2

(12) United States Patent
Ueki

(10) Patent No.: US 9,566,793 B2
(45) Date of Patent: Feb. 14, 2017

(54) IMAGE FORMING APPARATUS, IMAGE FORMING METHOD, AND NON-TRANSITORY COMPUTER READABLE MEDIUM

(71) Applicant: FUJI XEROX CO., LTD., Tokyo (JP)

(72) Inventor: Hiroyuki Ueki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/836,106

(22) Filed: Aug. 26, 2015

(65) Prior Publication Data

US 2016/0257128 A1 Sep. 8, 2016

(30) Foreign Application Priority Data

Mar. 4, 2015 (JP) ..... 2015-042450

(51) Int. Cl.
*B41J 2/165* (2006.01)
*B41J 2/17* (2006.01)
*B41J 11/00* (2006.01)

(52) U.S. Cl.
CPC ..... *B41J 2/1652* (2013.01); *B41J 2/16526* (2013.01); *B41J 2/1707* (2013.01); *B41J 11/002* (2013.01); *B41J 2002/16529* (2013.01)

(58) Field of Classification Search
CPC ..... B41J 2/16521; B41J 2/17071; B41J 2002/16529
See application file for complete search history.

(56) References Cited

U.S. PATENT DOCUMENTS 6,540,329 B1 * 4/2003 Kaneko ..... C09D 11/40 347/100
2006/0187285 A1 * 8/2006 Oyanagi ..... B41J 11/002 347/100
2010/0060682 A1 * 3/2010 Akatsuka ..... B41J 2/2114 347/9
2011/0242177 A1 * 10/2011 Sato ..... B41J 2/2132 347/15
2012/0026264 A1 2/2012 Ikoshi
2015/0062247 A1 * 3/2015 Shimomura ..... B41J 2/155 347/43

FOREIGN PATENT DOCUMENTS

JP 2007-144792 A 6/2007
JP 2012-030534 A 2/2012

OTHER PUBLICATIONS

Machine translation of JP 2007-428554 A. (JP 2007-428554 A was published on Jul. 14, 2007.).*

* cited by examiner

*Primary Examiner* — Justin Seo
(74) *Attorney, Agent, or Firm* — Oliff PLC

(57) ABSTRACT

Provided is an image forming apparatus including an ejection section that ejects liquid droplets of plural colors including black liquid droplets, a control section that controls the ejection section such that the black liquid droplets and at least a part of the liquid droplets of other colors contact on a recording medium when preliminary ejection is performed on a non-image forming region of the recording medium, and a drying section that dries the liquid droplets of the plural colors.

12 Claims, 7 Drawing Sheets

IMAGE FORMING APPARATUS, IMAGE FORMING METHOD, AND NON-TRANSITORY COMPUTER READABLE MEDIUM

CROSS-REFERENCE TO RELATED APPLICATIONS

This application is based on and claims priority under 35 USC 119 from Japanese Patent Application No. 2015-042450 filed Mar. 4, 2015.

BACKGROUND

Technical Field

The present invention relates to an image forming apparatus, an image forming method, and a non-transitory computer readable medium.

SUMMARY

According to an aspect of the invention, there is provided an image forming apparatus including:

an ejection section that ejects liquid droplets of plural colors including black liquid droplets;

a control section that controls the ejection section such that the black liquid droplets and at least a part of the liquid droplets of other colors contact on a recording medium when preliminary ejection is performed on a non-image forming region of the recording medium; and a drying section that dries the liquid droplets of the plural colors.

BRIEF DESCRIPTION OF THE DRAWINGS

Exemplary embodiments of the present invention will be described in detail based on the following figures, wherein.

DETAILED DESCRIPTION

Figure 1:
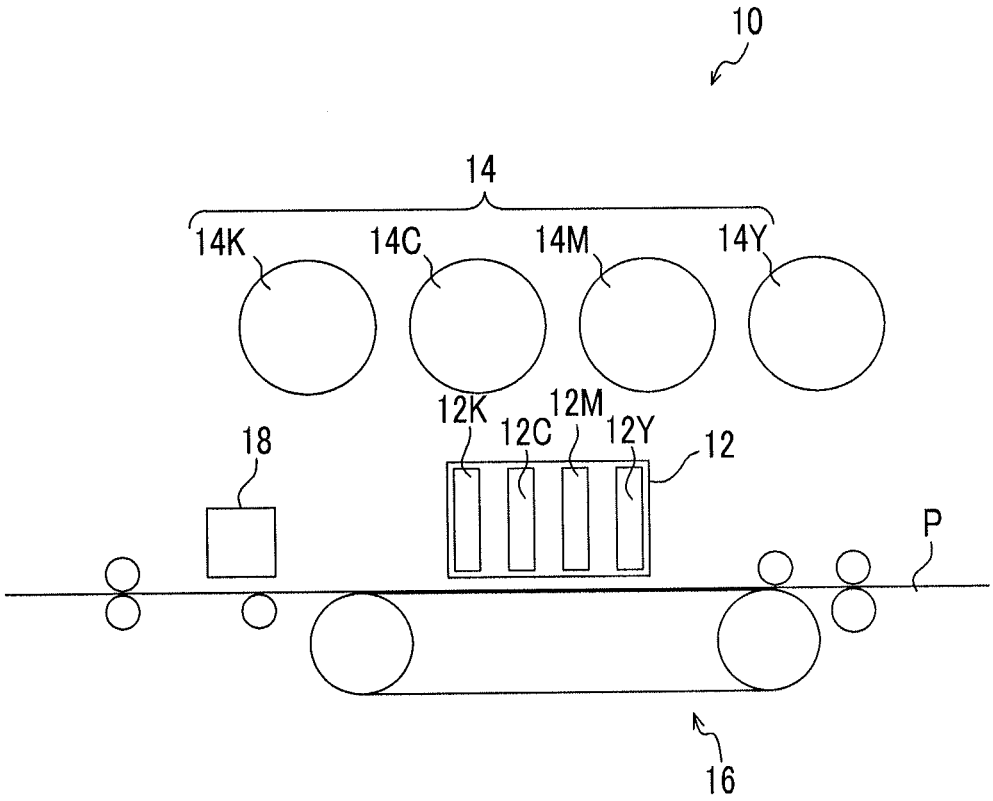
FIG. 1 is a diagram which shows a schematic configuration of an image forming apparatus according to the present exemplary embodiment.

Description will be given below of the present exemplary embodiment with reference to the diagrams. FIG. 1 is a diagram which shows a schematic configuration of an image forming apparatus according to the present exemplary embodiment. Here, in the present exemplary embodiment, description will be given of an image forming apparatus which ejects ink as liquid droplets as an example.

As shown in FIG. 1, in an image forming apparatus 10, print heads (12Y, 12M, 12C, and 12K) 12 which eject inks of colors Y (yellow), M (magenta), C (cyan), and K (black) are arranged in this order from the upstream side in the transport direction of continuous paper P which is the recording medium. In addition, ink tanks (14Y, 14M, 14C, and 14K) 14 which accommodate ink of each color corresponding to each color of the print heads 12 are provided. Below, in cases where description is given without particular distinction between each color of the print heads 12Y, 12M, 12C, and 12K and the ink tanks 14Y, 14M, 140, and 14K, the final reference letters will be omitted and reference will be made to the print heads 12 and the ink tanks 14.

In addition, the image forming apparatus 10 is provided with a transport section 16 including an endless belt type transporter which transports the continuous paper P and plural rollers or the like for transporting the continuous paper, and the continuous paper P is transported by the transport section 16.

Each of the print heads 12 which ejects ink of each color has a region which corresponds to the maximum width of the continuous paper P set as a printing region. That is, in each of the print heads 12, plural liquid droplet ejectors (nozzles) for ejecting the ink droplets are arranged in the width direction of the continuous paper P. Here, the nozzle rows of each of the print heads 12 may be arranged in a single row, or may be arranged in multiple rows. The image forming apparatus 10 prints across the entire width of the continuous paper by performing recording while transporting only the continuous paper while the print heads 12 are fixed without main scanning. In addition, the print heads 12 may be configured to be arranged such that plural printing units cover the recording medium in the width direction.

The liquid droplet ejectors of each print head 12 are configured to include ink pressure chambers which are connected with the nozzles in order to eject ink droplets, and piezoelectric elements (not shown in the diagrams) provided in contact with the ink pressure chambers. As is well known, piezoelectric elements have properties by which the shapes thereof change when a voltage is applied thereto and this change in shape is utilized to apply pressure to the ink pressure chambers, eject ink droplets from the nozzles, and record dots on the continuous paper P. At this time, by controlling the driving waveform of the voltage applied to the piezoelectric elements, ink droplets with three sizes of large droplets, medium droplets, and small droplets are ejected from the nozzles. In addition, in a case where ink droplets are not ejected from the nozzles (no droplets), increases in the viscosity of the ink are suppressed by applying a voltage of a waveform such that ink droplets are not ejected from the nozzles. In the present exemplary embodiment, description is given of an example of ejecting liquid droplets with three sizes: large, medium, and small; however, liquid droplets with two sizes of large and small may be ejected, or liquid droplets with four or more sizes may be ejected.

In addition, a drying device 18 is provided on the downstream side of the print heads 12 in the transport direction of the continuous paper P in order to dry the ink ejected onto the continuous paper P. In the present exemplary embodiment, an infrared heater is utilized as the drying device 18; however, other heaters may be employed. For example, a near-infrared heater which generates infrared rays in a wavelength range which is determined in advance may be utilized as an infrared heater.

Here, in the present exemplary embodiment, a non-permeable recording medium is utilized as the continuous paper P utilized as the recording medium; however, other recording media such as permeable recording media or the like may be utilized. In addition, in the present exemplary embodiment, the non-permeable recording medium refers to a recording medium into which ink droplets do not permeate or a recording medium into which it is difficult for ink droplets to permeate. Specifically, examples of a non-permeable recording medium include coated paper, resin films, and the like. More specifically, the non-permeable recording medium refers to a recording medium in which the maximum liquid absorption amount of the ink within a contact time of 500 ms or shorter measured using a dynamic scanning liquid absorption meter is 15 $ml/m^2$ or less.

Figure 2:
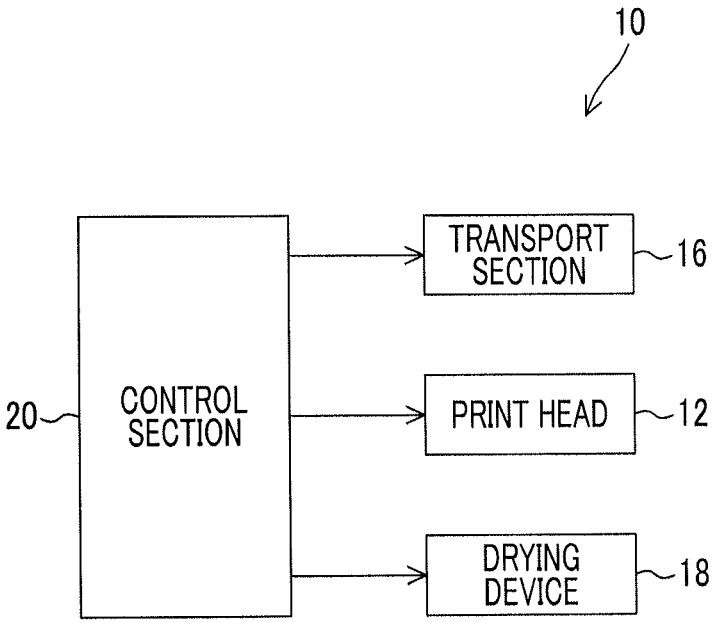
FIG. 2 is a block diagram which shows a configuration of a control system of the image forming apparatus according to the present exemplary embodiment.

Next, description will be given of the configuration of a control system of the image forming apparatus 10 according to the present exemplary embodiment. FIG. 2 is a block diagram which shows the configuration of the control system of the image forming apparatus 10 according to the present exemplary embodiment.

The image forming apparatus 10 is provided with a control section 20 for controlling the image forming operation. In the control section 20, the transport section 16, the print heads 12, and the drying device 18 are connected.

By controlling the driving of the transport section 16, the control section 20 transports the continuous paper P to the position of the print heads 12 and forms an image on the continuous paper P by controlling the timing of the ejection of the inks of each color from the print heads 12.

In addition, the control section 20 transports the continuous paper P on which an image is formed to the position of the drying device 18 by controlling the driving of the transport section 16, and dries the ink ejected onto the continuous paper P by operating the drying device 18.

In addition, as in the present exemplary embodiment, it is necessary to prevent the ink in the nozzles from drying in order to prevent clogging of the nozzles in the print heads 12 which eject the ink droplets. Therefore, in the present exemplary embodiment, preliminary ejection (so-called dummy jetting) for preventing the drying of ink in the nozzles by ejecting ink of each color in a non-image forming region is performed. That is, the control section 20 controls the print heads 12 so as to eject ink in the non-image forming region between two images. Here, the determination of whether or not a region is a non-image forming region may be determined from the transport volume of the transport section 16, or may be determined by providing a sensor or the like. Here, the image (page image) which is formed in the image forming region is an image formed based on image information from an external device such as a personal computer. In addition, the preliminary ejection is the ejection of inks of each color in the non-image forming region in order to prevent the drying of ink in the nozzles, and the image formed by the preliminary ejection is different from the page image. In addition, the non-image forming region is not limited to the space between one image and another image and a part of region of a part of the medium may be specified in advance as a non-image forming region. For example, a part of the image may be specified as blank (a non-image forming region) based on input information from an external source.

Figure 3A:
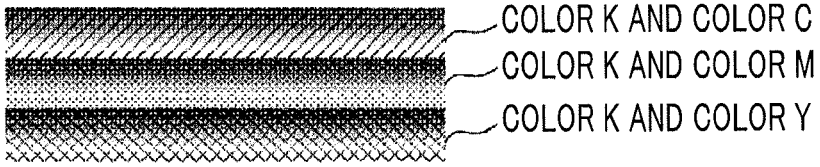
FIG. 3A shows an example of performing preliminary ejection such that color C and color K, color M and color K, and color Y and color K are respectively overlapped with each other.
Figure 3B:
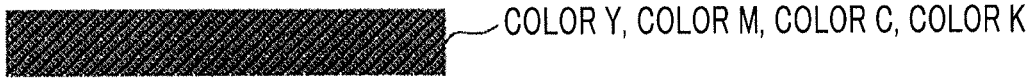
FIG. 3B shows an example of performing preliminary ejection such that color C, color M, color Y, and color K are overlapped with each other.
Figure 3C:
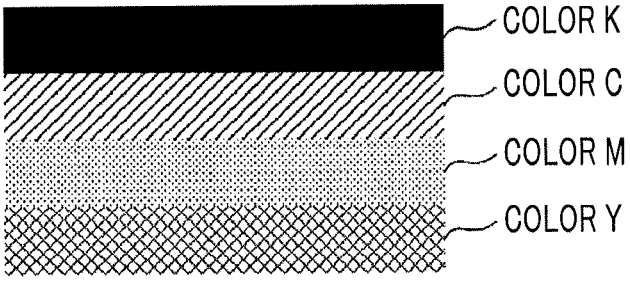
FIG. 3C shows an example of performing preliminary ejection such that line shape images are formed for each color.

Here, the preliminary ejection ejects ink onto the non-image forming region in order to prevent the ink drying as described above; however, the formed image is typically formed with line shapes in each color as shown in FIG. 3C.

However, the drying properties of color K ink and other color inks are different, with the color K ink drying more easily than other color inks. In particular, in a case where an infrared heater is utilized as the drying device 18 as in the present exemplary embodiment, there are differences in the temperatures of the ink droplets when heated by the drying device 18 depending on the color of ink, and there are differences in the drying properties. Specifically, black which is heated by an infrared heater set to the absorption wavelength of water increases in temperature more easily due to carbon black (for which the absorption wavelength is wider than inks of other colors) which is a coloring material and black dries more easily than other colors. In this manner, due to the drying properties being different according to the colors of the inks, even when dried by the drying device 18, images formed by the preliminary ejection of ink of colors other than K may be peeled by a transport roller or the like.

Therefore, in the present exemplary embodiment, in a case of performing the preliminary ejection, the control section 20 controls the print heads 12 such that the black ink and at least apart of the ink of other colors contact on the continuous paper P. Here, in the present exemplary embodiment, the contact between the inks includes cases where each color of ink is overlapped and cases where the inks are mixed.

Specifically, in a case where the ink is ejected onto the continuous paper P, the control section 20 controls the print heads 12 so as to eject the ink at a position where the color K ink and at least a part of the inks of other colors overlap each other or at a position where the inks of respective colors are combined on the continuous paper P. For example, as shown in FIG. 3A, preliminary ejection is performed such that color C and color K, color M and color K, and color Y and color K overlap each other. Alternatively, as shown in FIG. 3B, preliminary ejection is performed such that color C, color M, color Y, and color K overlap each other. Due to this, the color K ink improves the drying properties of the inks of other colors by mixing with the inks of other colors.

In addition, in the present exemplary embodiment, a fixing agent for improving the fixability is added to the color K ink, such that the fixability is improved over that of the other color inks. Due to this, peeling of the image formed by the preliminary ejection is reliably prevented due to the fixing agent which improves the fixability being included in the color K. Here, in the present exemplary embodiment, description is given of an example of adding a fixing agent to the color K ink; however, cases where a fixing agent (for example, polymer particles) is also added to inks of other colors (for example, all colors or some colors) are not excluded.

Here, when performing the preliminary ejection, in a case where ink is ejected such that the color K ink and the ink of other colors are overlapped, the droplet volume of the color K ink is preferably reduced (the size of the droplets is reduced) in order to prevent paper tearing due to the overlap printing. In particular, in a case of using a permeable recording medium, it is necessary to reduce the droplet volume in the case of overlapping inks. On the other hand, when using a non-permeable recording medium as in the present exemplary embodiment, the risk of paper tearing due to the overlapping is reduced.

Figure 4:
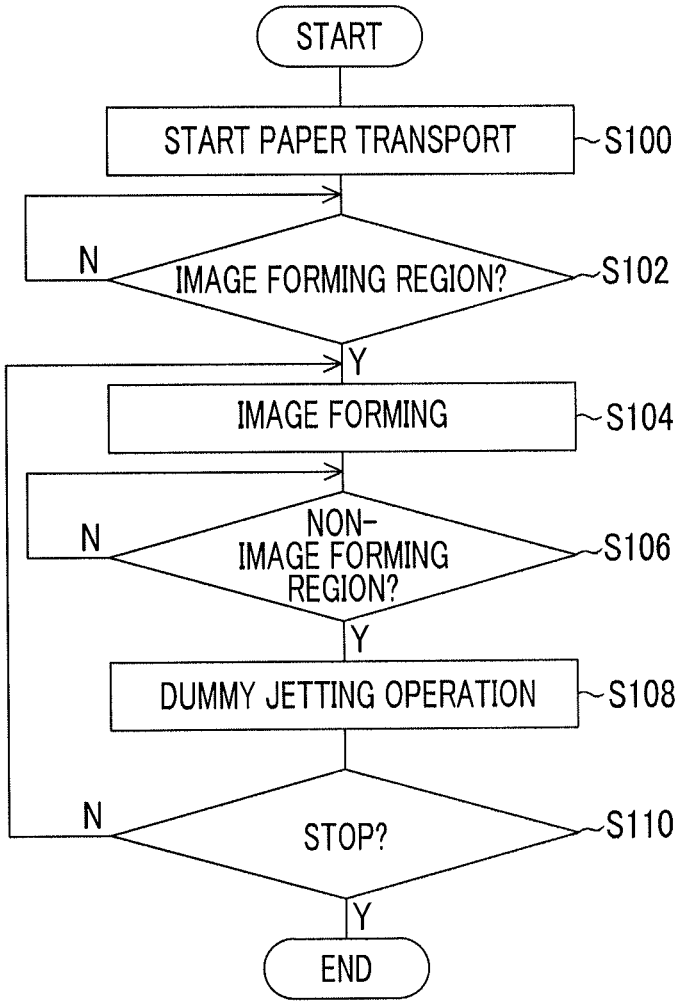
FIG. 4 is a flowchart which shows an example of a flow of a process performed by a control section of the image forming apparatus according to the present exemplary embodiment.

Subsequently, description will be given of the processes performed by the control section 20 of the image forming apparatus 10 according to the present exemplary embodiment configured as described above. FIG. 4 is a flowchart showing an example of a flow of processes performed by the control section 20 of the image forming apparatus 10 according to the present exemplary embodiment. The processes in FIG. 4 start when an instruction to start the image forming is given. In addition, the processes in FIG. 4 will be described as processes performed by the control section 20 executing a program stored in advance in a non-transitory computer readable medium.

First, in step S100, the control section 20 starts the transport of the continuous paper P by controlling the driving of the transport section 16, then the process proceeds to step S102.

In step S102, the control section 20 determines whether or not the continuous paper P is transported to the image forming region. This determination determines whether or not the continuous paper P has reached the portion where printing by the print heads 12 is possible. For example, whether or not the transport section 16 has transported a transport volume determined in advance may be detected, or it may be determined by detecting the position of the continuous paper P using a sensor or the like. The process remains on standby until the result of the determination is positive and then the process proceeds to step S104.

In step S104, the control section 20 controls the print heads 12, image forming is performed, and the process proceeds to step S106. That is, the control section 20 controls the print head of each color such that ink is ejected from the print head 12 of each color according to the image information.

In step S106, the control section 20 determines whether a region is a non-image forming region. This determination determines, for example, whether to position the print heads 12 in the non-image forming region between an image and another image on the continuous paper P when finishing image forming for one page. More specifically, it is determined whether the transporting of the continuous paper from the start of the image forming has reached a transport volume of one page, or the like. In a case where the result of the determination is negative, the process remains on standby until the result is positive and then the process proceeds to step S108.

In step S108, the control section 20 controls the print heads 12, a preliminary ejection operation is performed, and the process proceeds to step S110. That is, as described above, ink is ejected from the print heads 12 onto the continuous paper P at a position where color K ink and inks of other colors overlap or combine on the continuous paper P. Due to this, drying is promoted due to the color K ink being mixed with the inks of other colors, and the drying property is improved in comparison with ejecting the inks of colors other than the color K independently. In particular, since an infrared heater is utilized as the drying device 18 in the present exemplary embodiment, the drying property for the color K is noticeably better than for the other colors. For this reason, the drying property of the other inks is improved due to the mixing of the other inks and the color K ink. In addition, peeling of the image formed by the preliminary ejection is reliably prevented due to the material which improves the fixability being included in the color K. Furthermore, in the present exemplary embodiment, since the print head 12K of the color K is positioned on the downstream side in the transport direction with respect to the other colors, the surface is coated by the color K ink which has a higher fixability than the other colors, and the image is more resistant to peeling.

In step S110, the control section 20 determines whether the image forming has finished. In this determination, for example, the control section 20 determines whether or not the image forming which corresponds to the image information has all finished, or the like. If the result of this determination is negative, the process returns to step S104 to form the remainder of the image, the above-described processes are repeated, and a series of processes is finished when the determination result is positive.

EXAMPLES

Detailed description will be given below of the present invention using Examples; however, the invention is not limited to these Examples.

Specifically, description will be given of confirmation results of the peeling of formed images in cases where preliminary ejection is performed for each color and in cases where preliminary ejection is performed such that the color K and the other colors are overlapped or combined on continuous paper.

In the image forming apparatus 10 with a printing speed of 100 m/min and having the drying device 18 formed of an infrared heater, 600 dpi piezo-heads (maximum droplet amount 11 [pl]) are used as the print heads 12.

(Color K Ink (Suitable for Print Coated Paper))

Carbon black (Mogul L: manufactured by Cabot Corp.) (coloring agent): 5% by weight Styrene/acrylic acid copolymer sodium neutralized product: 2.5% by weight (Water-soluble resin, weight-average molecular weight=30,000)

TOCRYL W-4627 (acrylic emulsion, manufactured by TOYOCHEM Co., Ltd.): 2.0% by weight (solid)

(Polymer particles, volume-average particle diameter=0.12 μm, glass transfer temperature=45° C.)

Glycerin: 10% by weight

Diethylene glycol: 10% by weight

Surfactant (Olfine E1010, Surfynol 104PG-50): 2% by weight each

Ion-exchanged water: remainder

After mixing, the composition described above is subjected to filtration with a 5 μm filter, and an aqueous ink (ink K) is obtained.

Here, in addition to the above,

Olfine E1010, EXP.4001, EXP.4123, EXP.4300: ethylene oxide adducts of acetylenic diols, Silface SAG002, and SAG503A: polyether-modified silicone may be used as surfactants.

(Inks of Colors C, M, Y (not Suitable for Print Coated Paper))

The inks include pigments, resin dispersants, glycerin, diethylene glycol, butyl carbitol, and Olfine E1010. Here, a resin emulsion and a hydrophobic surfactant are not included.

(Recording Medium)

Ok Top Coat+104.7 [g/m$^2$]

(manufactured by Oji Paper Co., Ltd.)

Figure 5A:
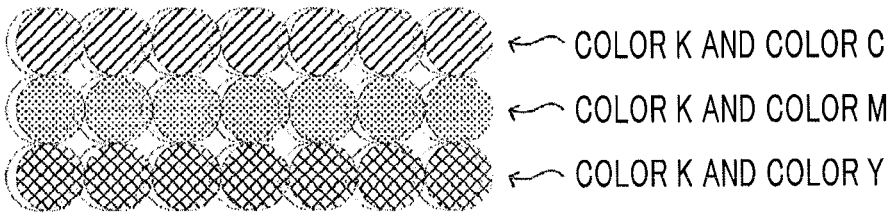
FIG. 5A shows an aspect in which preliminary ejection is performed such that color C and color K, color M and color K, and color Y and color K are respectively overlapped to form line shapes.
Figure 5B:
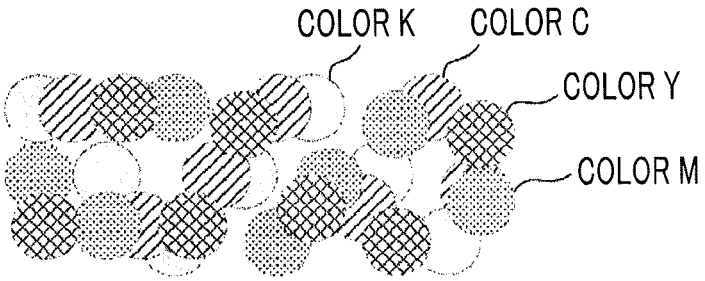
FIG. 5B shows an aspect in which preliminary ejection is performed such that inks of each of color C, color M, color Y, and color K are ejected to form a line shape in a process black.
Figure 5C:
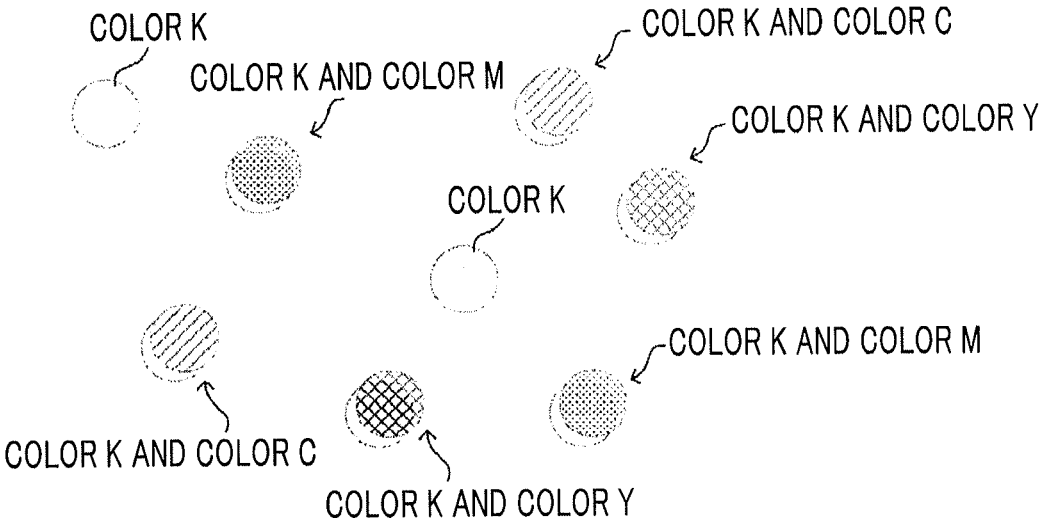
FIG. 5C shows an aspect in which preliminary ejection is performed such that ink is ejected at a random position in a non-image forming region and color K and other colors are overlapped.
Figure 6A:
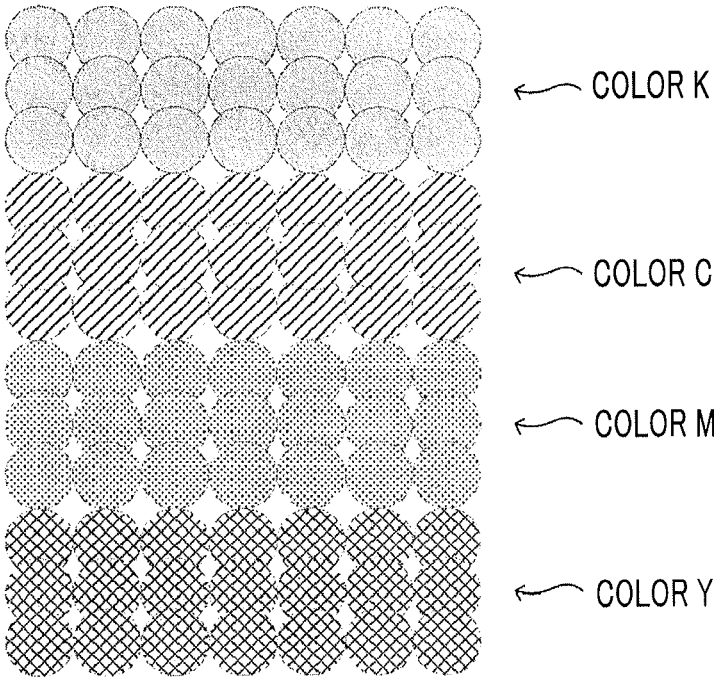
FIG. 6A shows an aspect in which preliminary ejection is performed in which each color forms a line shape for plural rows.
Figure 6B:
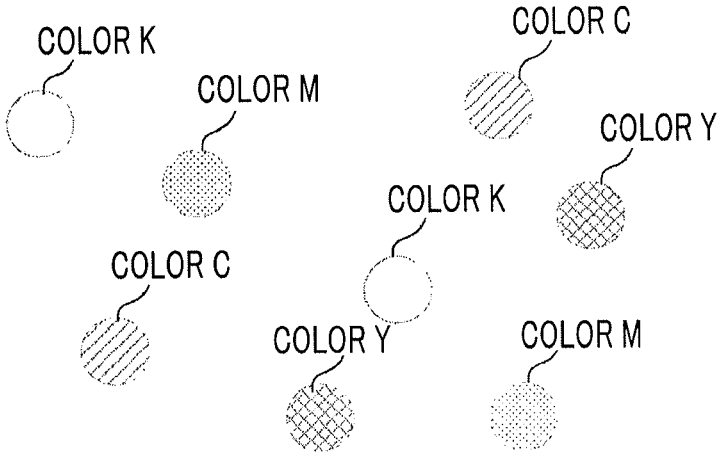
FIG. 6B shows an aspect in which ink of each color is ejected at a random position in the non-image forming region.

The aspects shown in FIG. 5A to FIG. 6B are used as the aspects of the preliminary ejection. In detail, peeling is confirmed for each image using the aspect shown in FIG. 5A for the first exemplary embodiment, the aspect shown in FIG. 5B for the second exemplary embodiment, and the aspect shown in FIG. 5C for the third exemplary embodiment. In addition, peeling is confirmed for each image using the aspect shown in FIG. 6A for a first comparative example, the aspect shown in FIG. 6B for a second comparative example. Here, FIG. 5A shows an aspect in which preliminary ejection is performed such that color C and color K, color M and color K, and color Y and color K are overlapped with each other and formed line shapes. FIG. 5B shows an aspect in which preliminary ejection is performed such that inks of color C, color M, color Y, and color K are each ejected to form a line shape in a process black. FIG. 5C shows an aspect in which preliminary ejection is performed such that ink is ejected at random positions in the non-image forming region and color K and the other colors are overlapped. On the other hand, FIG. 6A shows an aspect in which preliminary ejection is performed in which each color forms a line shape for each of plural rows. FIG. 6B shows an aspect in which ink of each color is ejected at random positions in the non-image forming region.

As shown in the table below, the image peeling confirmation results are favorable and image peeling did not occur in the first exemplary embodiment to the third exemplary embodiment. On the other hand, in the first and second Comparative Examples, there is image peeling.

TABLE 1

| | First Exemplary Embodiment | Second Exemplary Embodiment | Third Exemplary Embodiment | First Comparative Example | Second Comparative Example |
|---|---|---|---|---|---|
| Peeling present or absent | Absent | Absent | Absent | Present | Present |

Figure 7:
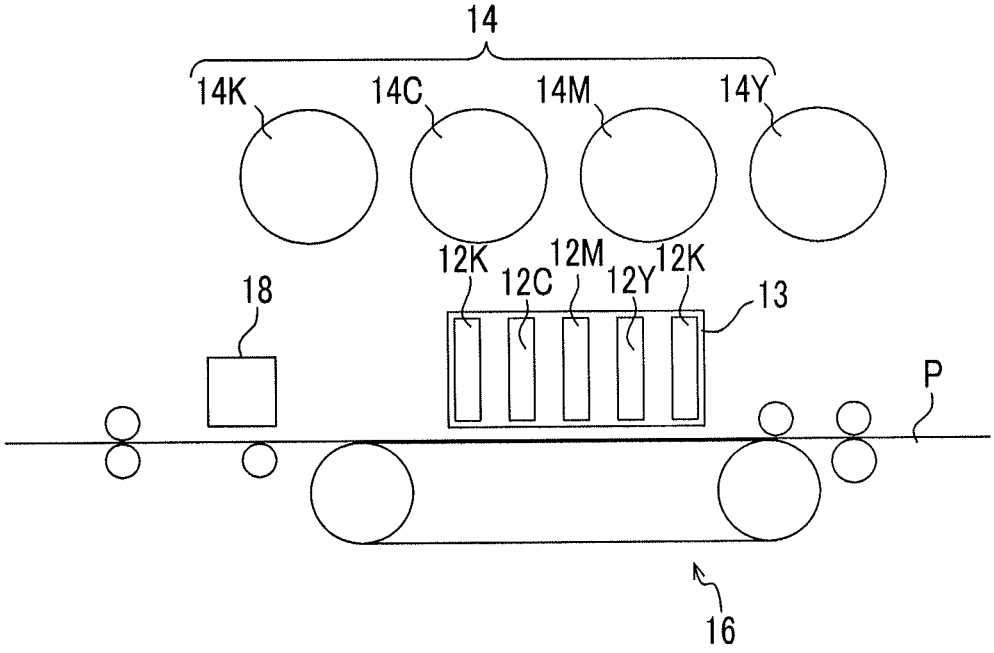
FIG. 7 is a diagram which shows an example of print heads provided with two print heads of color K, and arranged in order of color K, color Y, color M, color C, and color K.

Here, in the exemplary embodiments described above, since the print head 12 of each of the colors is arranged in order of color Y, color M, color C, and color K, the inks are ejected in this order; however, the invention is not limited to this arrangement. For example, the print head 12K of the color K may be arranged on the upstream side of the continuous paper P in the transport direction and configured to eject first. Alternatively, when performing the preliminary ejection, the ejection may be carried out such that the inks of other colors are interposed between the color K ink. For example, as shown in FIG. 7, a print head 13 provided with two print heads 12K of color K, and in which print head of each color is arranged in order of color K, color Y, color M, color C, and color K may be utilized, and, when performing the preliminary ejection, the ejection may be carried out such that the inks of other colors are interposed between the color K ink. In such a case, in order to prevent tearing of the recording medium, it is desirable to reduce the droplet volume of the color K ink and the inks of the other colors.

In addition, in the exemplary embodiment described above, an infrared heater is utilized as the drying device 18; however, the invention is not limited thereto, and other types of drying devices may be utilized. In addition, the invention is not limited to non-contact type drying devices and may utilize contact type drying devices.

In the exemplary embodiment described above, description is given of an example of performing the preliminary ejection in the non-image forming region; however, the preliminary ejection may be performed in an image forming region. For example, the preliminary ejection may be executed such that small inconspicuous dots are formed in the vicinity of an end section or the like of the image forming region.

In addition, in the exemplary embodiments described above, description is given of an example of performing the processes of FIG. 4 by a computer executing a program in a non-transitory computer readable medium; however, a part or all of the processes executed by the program in the non-transitory computer readable medium may be executed by hardware.

In addition, the processes performed by the image forming apparatus 10 according to the exemplary embodiments described above may be stored and run as a program in a storage medium.

In addition, the present invention is not limited to the description above. In addition to the description above, it is naturally possible to realize the invention through various modifications within a range not departing from the gist of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an ejection section that ejects liquid droplets of a plurality of colors including black liquid droplets;

a control section that controls the ejection section so as to eject liquid droplets of each color at a position where the black liquid droplets and at least a part of the liquid droplets of other colors overlap each other on a recording medium or at a position where the black liquid droplets and the liquid droplets of other colors are combined on a recording medium when preliminary ejection is performed on a non-image forming region of the recording medium;

a drying section that dries the liquid droplets of the plurality of colors; and wherein the control section controls the ejection section so as to carry out the overlapping in order of black liquid droplets, liquid droplets of other colors, and black liquid droplets.

2. The image forming apparatus according to claim 1, wherein the black liquid droplets contain a predetermined fixing agent.

3. The image forming apparatus according to claim 1, wherein the control section controls the ejection section so as to eject the black liquid droplets onto the liquid droplets of other colors.

4. The image forming apparatus according to claim 2, wherein the control section controls the ejection section so as to eject the black liquid droplets onto the liquid droplets of other colors.

5. The image forming apparatus according to claim 3, wherein the ejection section includes a black ejection section that ejects black liquid droplets, and a color ejection section that ejects liquid droplets of colors other than black, the black ejection section and the color ejection section being arranged in a transport direction of the recording medium in order of the black ejection section and the color ejection section.

6. The image forming apparatus according to claim 4, wherein the ejection section includes a black ejection section that ejects black liquid droplets, and a color ejection section that ejects liquid droplets of colors other than black, the black ejection section and the color ejection section being arranged in a transport direction of the recording medium in order of the black ejection section and the color ejection section.

7. The image forming apparatus according to claim 1, wherein the ejection section includes two black ejection sections that eject black liquid droplets, and a color ejection section that ejects liquid droplets of colors other than black, the black ejection section and the color ejection section being arranged in the transport direction of the recording medium in order of the black ejection section, the color ejection section, and the black ejection section.

8. The image forming apparatus according to claim 1, wherein the drying section is a non-contact type infrared heater.

9. The image forming apparatus according to claim 1, wherein the recording medium is a non-permeable recording medium.

10. A non-transitory computer readable medium storing a program causing a computer to function as the control section of the image forming apparatus according to claim 1.

11. An image forming apparatus comprising:

an ejection section that ejects liquid droplets of a plurality of colors including black liquid droplets;

a control section that controls the ejection section such that the black liquid droplets and at least a part of the liquid droplets of other colors overlap on a recording medium when preliminary ejection is performed on a non-image forming region of the recording medium, and wherein the control section controls the ejection section so as to carry out the overlapping in order of black liquid droplets, liquid droplets of other colors, and black liquid droplets; and a drying section that dries the liquid droplets of the plurality of colors.

12. An image forming method comprising:

performing preliminary ejection in a non-image forming region of a recording medium, using an ejection section that ejects liquid droplets of a plurality of colors including black liquid droplets, by ejecting liquid droplets such that the black liquid droplets and at least a part of the liquid droplets of other colors overlap each other, wherein the overlapping is carried out in the order of black liquid droplets, liquid droplets of other colors, and black liquid droplets.

* * * * *